United States Patent [19]

Manderscheid

[11] Patent Number: 4,523,641

[45] Date of Patent: Jun. 18, 1985

[54] LINER HANGER WITH CHANNEL GUIDES

[75] Inventor: Phillip H. Manderscheid, Cypress, Tex.

[73] Assignee: Hughes Tool Company, Houston, Tex.

[21] Appl. No.: 574,428

[22] Filed: Jan. 27, 1984

[51] Int. Cl.[3] ..... E21B 23/00; E21B 23/04

[52] U.S. Cl. ..... 166/208; 166/212; 166/213

[58] Field of Search ..... 166/208, 209, 211, 212, 166/214–217, 120, 213

[56] References Cited

U.S. PATENT DOCUMENTS

| | | | |
|---|---|---|---|
| 2,053,065 | 9/1933 | Crowell | 103/219 |
| 3,195,646 | 7/1965 | Brown | 166/208 |
| 3,291,220 | 12/1966 | Mott | 166/208 |
| 3,608,634 | 9/1971 | Cochran | 166/208 |
| 3,993,128 | 11/1976 | Braddick | 166/216 |
| 4,060,131 | 11/1977 | Kennedy | 166/315 |
| 4,249,601 | 2/1981 | White | 166/208 |
| 4,311,194 | 1/1982 | White | 166/120 |
| 4,364,432 | 12/1982 | Bass et al. | 166/208 X |

*Primary Examiner*—Stephen J. Novosad

*Assistant Examiner*—Thuy M. Bui

*Attorney, Agent, or Firm*—Robert A. Felsman; Charles D. Gunter, Jr.

[57] ABSTRACT

A liner hanger is shown of the type used to hang a well liner in a surrounding well bore. The hanger includes a tubular mandrel which is connectible in a liner string. A set of circumferentially-spaced gripping slips are mounted about the mandrel with each slip having a spring arm extending therefrom in alignment with the axis of the mandrel. A tapered, slip expander cone is mounted on the mandrel exterior above each of the slips for expanding the slips radially outwardly in the direction of the surrounding well bore responsive to opposite relative movement of the slips and cones. At least one channel guide is formed on the exterior of the mandrel in longitudinal alignment with one of the expander cones. The channel guide includes a slot portion for slidably receiving the spring arm of one of the gripping slips for supporting the slip on the exterior of the mandrel. A setting mechanism urges the slips in the direction of the cones to effect the outward, radial expansion of the slips to thereby hang the mandrel, and, in turn, the liner within the well bore.

5 Claims, 4 Drawing Figures

LINER HANGER WITH CHANNEL GUIDES

BACKGROUND OF THE INVENTION

1. Field of the Invention

The present invention relates to a liner hanger device of the type used to hang a liner in a surrounding well bore and, specifically, to improvements in the system by which the gripping slips of the device are mounted and supported on the exterior of the device.

2. Description of the Prior Art

Liner hangers are typically used in well operations to attach an inner string of well pipe to the lower end, or at some other point, within a larger diameter well pipe or casing. The liner hanger typically comprises a device which is attached to the liner and which includes a set of pipe gripping slips which are arranged to be expanded into gripping engagement with the interior of the larger diameter pipe to thereby secure the smaller diameter pipe or liner thereto. The term "pipe" will be understood to mean pipe, tubing or casing of the type used in well bore operations. After hanging the liner, the liner will usually be cemented, which requires the circulation of fluids through the interior of the liner and upwardly about the exterior of the liner between the liner and the outer casing.

In many cases, liners comprise long and heavy strings of pipe extending below the hanger and thus require large slip contact areas in order to assure effective attachment of the liner within the existing casing. Because of the close clearances which many times exist between the liner and the surrounding casing, or open hole in some cases, if sufficient slip area is provided to support such a long and heavy liner string, this will frequently tend to close off the annular space between the liner and surrounding well bore which, in turn, severely restricts the flow of fluid which is being circulated.

U.S. Pat. No. 3,195,646 to C. C. Brown, issued July 20, 1965, shows a liner hanger which employs multiple cones, each of which has a plurality of spaced-apart cone segments. The cones segments are spaced-apart to provide pathways or spaces which provide increased circulating capacity. The liner hanger has two staggered sets of gripping slips, with three slip segments in each set. The gripping slips are vertically aligned with mating cone segments and the staggered design provides a large by-pass area for easy running and free circulation of fluids. The large distributed slip contact area also reduces stress in the supporting casing.

Because of the multiple cone, staggered slip arrangement utilized, the gripping slips were mounted on the exterior of the hanger by a slip support collar. Each slip was secured to its respective slip collar by means of a spring arm which normally biased the slips inwardly toward the exterior surface of the hanger. While the mounting method shown in U.S. Pat. No. 3,195,646 works well in practice, the slip support collars require milling and welding and add to the cost of building and assembling the tool.

SUMMARY OF THE INVENTION

The liner hanger of the invention includes a tubular mandrel connectible into a liner string. A set of circumferentially-spaced, gripping slips is mounted about the mandrel. Each of the gripping slips has a spring arm extending therefrom in axial alignment with the mandrel. A tapered, slip expander cone is mounted on the mandrel exterior above each of the slips for expanding the slips radially outwardly in the direction of the surrounding well bore responsive to opposite relative movement of the slips and cones. At least one channel guide is formed on the exterior of the mandrel in longitudinal alignment with one of the expander cones. The channel guide includes a slot portion for slidably receiving the spring arm of one of the gripping slips for supporting the slip on the exterior of the mandrel. Setting means are provided for urging the slips in the direction of the cones to effect the outward, radial expansion of the slips to thereby hang the mandrel and, in turn, the liner within the well bore.

Preferably, two sets of circumferentially-spaced gripping slips are mounted on the mandrel with each of the gripping slips having a spring arm extending therefrom in axial alignment with the mandrel. The slips of one set are angularly oriented with respect to the other to align the spaces between one of the sets of slips with the slips of the other set. At least two sets of tapered, slip expander cones are preferably mounted on the mandrel. Each of the cone sets includes a plurality of circumferentially-spaced cone segments mounted on the mandrel and arranged with one of the cone segments above each of the slips for expanding the slips radially outwardly in the direction of the surrounding well bore. The channel guides are preferably formed on the exterior of the mandrel in the spaces between circumferentially-spaced cone segments in at least one of the sets of tapered, slip expander cones.

Additional objects, features and advantages will be apparent in the written description which follows.

DETAILED DESCRIPTION OF THE INVENTION

Figure 1:
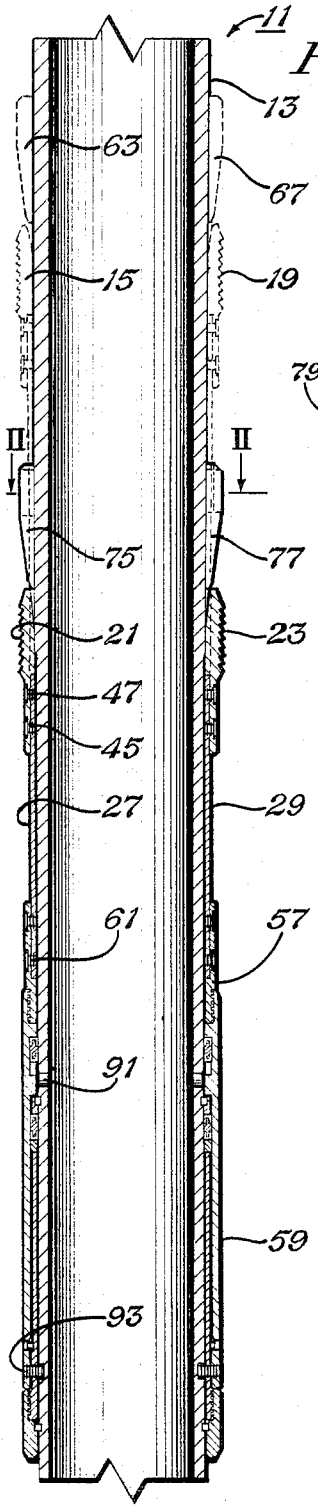
FIG. 1 is a side, cross-sectional view of a liner hanger of the invention with portions thereof broken away.

FIG. 1 shows a liner hanger, designated generally as 11, of the type used to hang a well liner in a surrounding well bore. The liner hanger 11 includes a tubular mandrel 13 which is connectible into a liner string in the conventional manner. That is, the mandrel 13 includes upper connecting means (not shown) for connecting the hanger 11 in a pipe string running to the well surface and also is provided with lower connecting means (not shown) for connecting the continuation of a liner string therebelow.

Figure 3:
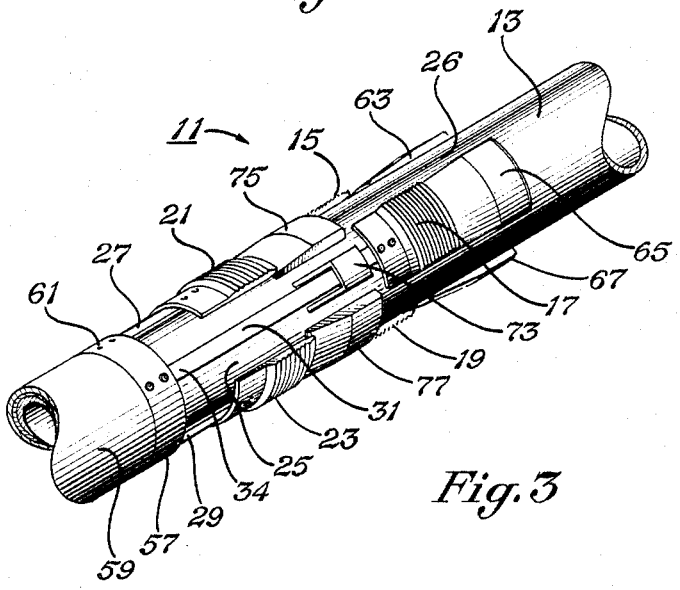
FIG. 3 is a partial perspective view of the liner hanger of FIG. 1 showing the slip mounting mechanism of the invention.

As best seen in FIG. 3, the liner hanger 11 has upper and lower sets of circumferentially-spaced gripping slips mounted about the mandrel 13. Upper slips 15, 17, and 19 can be seen in FIG. 3. Slips 21 and 23 of the lower set of slips can also be seen in FIG. 3. The slips are generally rectangular in shape and comparatively narrow in width, thereby providing substantial spaces, as at 25 in FIG. 3, between slips 21 and 23. The upper set of slips includes three slips 15, 17, 19 which are spaced on centers 120 degrees apart. The relative widths of the slips and spaces are approximately the same, so that about half of the circumference of the annulus occupied by each set of slips is in the form of open passageways between the slips. The lower set of slips is similarly arranged.

Figure 4:
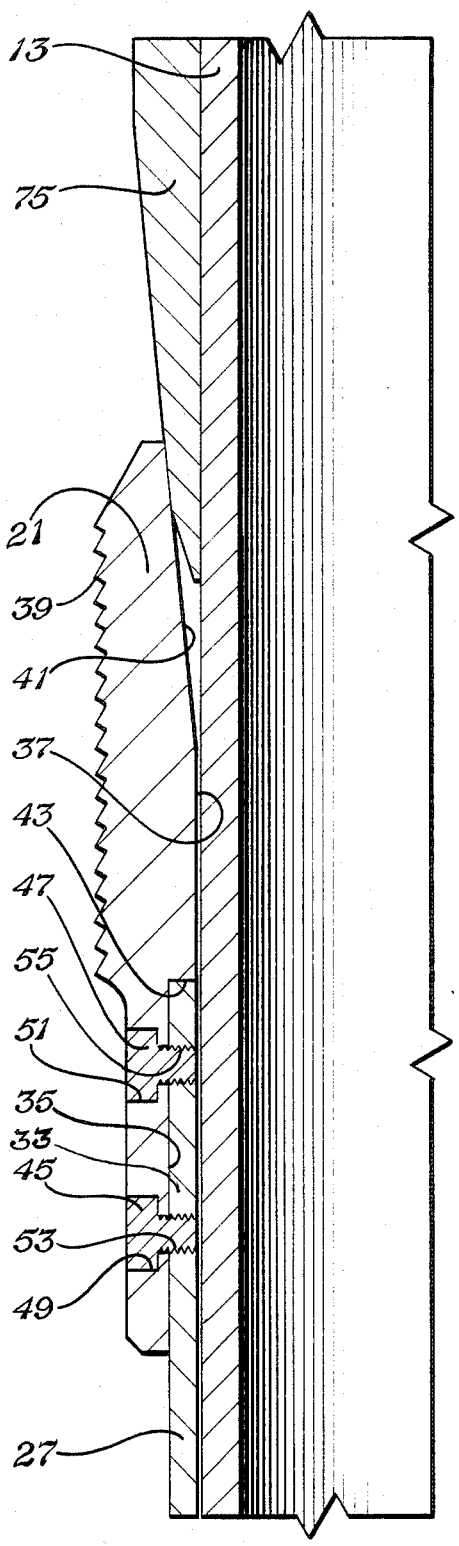
FIG. 4 is a close-up, side cross-sectional view of the slip and spring-arm of the liner hanger of FIG. 1.

Each of the slips has a spring arm such as spring arms 27, 29 and 31 shown in FIG. 3 which extend therefrom in axial alignment with the mandrel 13. As best seen in FIG. 4, each spring arm 27 is a metal bar of rectangular cross section which includes an upper end 33 which is received within a recess 35 formed within the lower surface 37 of the slip 21. The slip 21 has a serrated upper surface 39, a sloping underside 41 and a stepped region at recess 35 which joins the sloping underside 41 to form a shoulder 43 for receiving the upper end 33 of the spring arm 27. The spring arm upper end 33 is retained in position against shoulder 43 by suitable connecting means such as screws 45, 47 which are inserted within openings 49, 51 in the slip upper surface and which pass downwardly into threaded bores 53, 55 provided in the upper end 33. In assembling the tool, the spring arm upper ends 33 butt against the slip shoulders 43 before the connecting screw 45, 47 are tightened. As a result, the screws 45, 47 have no load in shear, eliminating the possibility that the screws will be sheared during the setting operation.

As shown in FIGS. 1 and 3, the ends 34 of the slip spring arms are similarly connected to the ring portion 57 of a setting sleeve 59, as by screws 61. That is, the ends 34, opposite upper ends 33, are joined at the underside of the ring portion 57 (FIG. 1) and abut a shoulder on the ring underside to eliminate the possibility of screws 61 shearing during setting.

The liner hanger 11 also includes an upper and a lower set of tapered, slip expander cones mounted on the mandrel 13. As best seen in FIG. 3, the upper set of cones includes cone segments 63, 65, 67 with one of the respective cone segments being fixed in position above each of the upper slips 15, 17, 19 for expanding the slips radially outwardly in the direction of the surrounding well bore responsive to opposite relative movement of the slips and cones. Each of the cone segments contained in the upper and lower sets of cones is spaced-apart to provide spaces, as at 25 and 26, in FIG. 3. In the embodiment shown in FIG. 3, each of the slip expander cones is defined by three cone segments spaced apart 120 degrees on centers. The widths of the respective cone segments are approximately the same as the widths of the related slips and, thus, the spaces 25, 26 will likewise correspond to about half the total circumference of the cones.

Each of the cone segments, such as segments 63, 65, 67, is vertically aligned with the related slips and, in the preferred arrangement, the slips and cone segments of one of the sets is angularly oriented with respect to the other set, so that the slip and cone segments of one set will be staggered or interspersed with the slips and cone segments of the other sets. It can be seen in FIG. 3, that when the setting sleeve 59 is actuated to produce relative longitudinal movement between the mandrel and slips, the cone segments will be caused to move inside the slips so that the tapered surfaces of the cone segments will cooperate with the corresponding surfaces on the undersides of the slips to urge the slips radially outwardly into gripping engagement with a surrounding well bore or casing.

Figure 2:
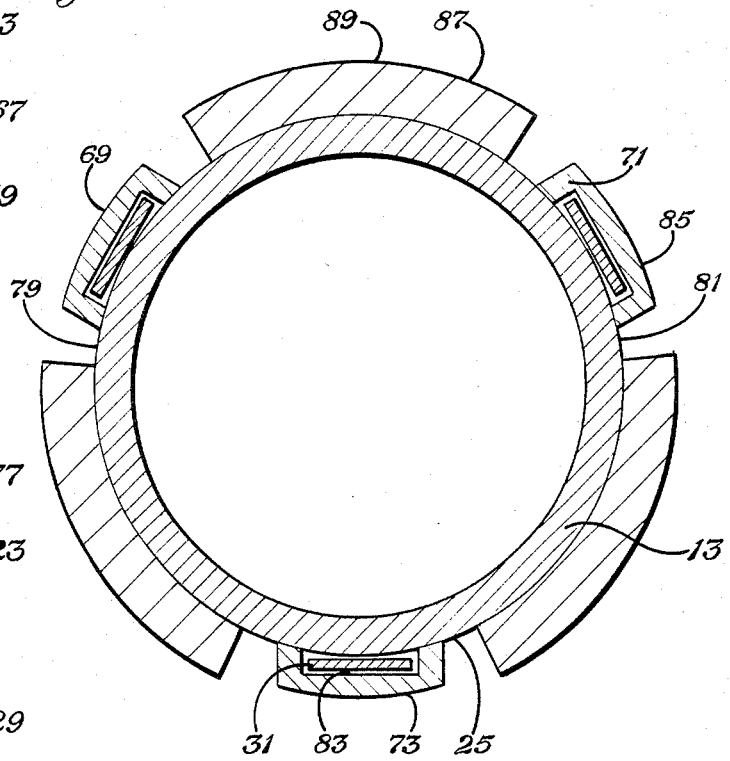
FIG. 2 is a cross-sectional view of the liner hanger of the invention taken along lines II, II in FIG. 1.

As shown in FIGS. 2 and 3, the liner hanger also includes a plurality of channel guides 69, 71, 73, each of the channel guides being formed on the exterior of the mandrel 13 in the spaces between circumferentially-spaced cone segments. Thus, as shown in FIG. 3, the channel guide 73 is formed in the space 25 between spaced-apart cone segments 75, 77 in the lower set of tapered, slip expander cones. As shown in FIG. 2, channel guides 69, 71 are similarly formed in the spaces 79, 81 around the remainder of the circumference of the mandrel 13. Each of the channel guides, such as guide 73, includes a slot portion 83 (FIG. 2) for slidably receiving the spring arm 31 of one of the slips in the upper set of gripping slips for supporting the slips on the exterior of the mandrel 13. Since the spring arms 27, 29 of the lower slips 21, 23 are of shorter relative length than the spring arms 31 of the upper slips 17, only the upper slips 17 are provided with channel guides 73 in the embodiment shown.

As shown in FIGS. 2 and 3, the channel guides are metal channels welded on the exterior of the tubular mandrel 13. The channel guides have a top surface, as at 85 in FIG. 2, which does not extend beyond the thickest region 87 of the adjacent cone segment 89.

In operation, the lower end of mandrel 13 would be closed off, as by dropping a ball into a suitably positioned ball seat, and the tubing string would be pressured up from the surface. The pressure within mandrel 13 is communicated through a port 91 (FIG. 1) and acts upon setting sleeve 59 to shear pins 93. By further increasing the tubing pressure, setting sleeve 59 is moved upwardly, thereby causing the upper and lower gripping slips to be expanded radially outwardly upon contact with the associated cone segments. The force exerted by the spring arms (27 in FIG. 4) acts upon the shoulders 43 formed in the slip lower surfaces 37 and not upon the connecting screws 45, 47.

The invention provided has several advantages. The use of channel guides eliminates the prior art spring collars and all of the milling and welding operations associated with such collars. The channel guides of the invention serve both to align the spring arms properly with respect to the cones and to retain the spring arms and slips against the body of the tool to prevent the slips from fluttering during tripping into the well bore. In the past, separate structures were required to perform these tasks. The liner hanger of the invention is therefore more economical to build and assemble. The use of channel guides provides a liner hanger with a shorter working area on the hanger body. The channel guide support mechanism is extremely sturdy and improves the reliability and operation of the tool. By having the spring arm upper ends received within a recess in the lower surface of the slips, force applied to the spring arms by the setting sleeve acts on the slip shoulder formed in the slip lower surface and not on the connecting screws used to attach the spring arms to the slips. The spring arm lower ends are similarly received within the underside of the setting sleeve. This arrangement eliminates the possibility that the connecting screws will be sheared during the setting operation.

Since the spring arms are located directly on the surface of the mandrel instead of being spaced further apart toward the tool outer diameter, the tool has improved reliability while running into the well bore. The reduced spring arm profile reduces the chance that parts of the tool will be snagged by debris, trash, or an imperfection in the interior of the casing.

While the invention has been shown in only one of its forms, it is not thus limited but is susceptible to various changes and modifications without departing from the spirit thereof.

I claim:

1. A liner hanger of the type used to hang a well liner in a surrounding well bore, comprising:

a tubular mandrel connectible into a liner string;

a set of circumferentially-spaced, gripping slips mounted about said mandrel, each of said gripping slips having a spring arm extending therefrom in axial alignment with said mandrel;

a tapered, slip expander cone mounted on said mandrel exterior above each of said slips for expanding said slips radially outwardly in the direction of the surrounding well bore responsive to opposite relative movement of said slips and cones;

at least one channel guide formed on the exterior of said mandrel in longitudinal alignment with one of said expander cones, said channel guide including a slot portion for slidably receiving the spring arm of one of said gripping slips for supporting said slip on the exterior of said mandrel; and setting means for sliding said spring arms within said channel guides to thereby urge said slips in the direction of said cones to effect the outward, radial expansion of said slips to thereby hang said mandrel and, in turn, said liner within the well bore.

2. A liner hanger of the type used to hang a well liner in a surrounding well bore, comprising:

a tubular mandrel connectible into a liner string;

at least two sets of circumferentially-spaced, gripping slips mounted about said mandrel, each of said gripping slips having a spring arm extending therefrom in axial alignment with said mandrel, the slips of one set being angularly oriented with respect to the other to align the spaces between one of the sets of slips with the slips of the other set;

at least two sets of tapered, slip expander cones mounted on said mandrel, each of said cone sets including a plurality of circumferentially-spaced cone segments mounted on said mandrel and arranged with one of said cone segments above each of said slips for expanding said slips radially outwardly in the direction of the surrounding well bore responsive to opposite relative movement of said slips and cones;

at least one channel guide formed on the exterior of said mandrel in longitudinal alignment with one of said expander cones, said channel guide including a slot portion for slidably receiving the spring arm of one of said gripping slips for supporting said slips on the exterior of said mandrel, said channel guides being formed on the exterior of said mandrel in the radial spaces between circumferentially-spaced cone segments in one of said sets of tapered, slip expander cones; and setting means for sliding said spring arms within said channel guides to thereby urge said slips in the direction of said cones to effect the outward, radial expansion of said slips to thereby hang said mandrel and, in turn, said liner within the well bore.

3. The liner hanger of claim 2, wherein said channel guides are metal channels welded on the exterior of said tubular mandrel.

4. A hydraulically set liner hanger of the type used to hang a well liner in a surrounding well bore, comprising:

a tubular mandrel connectible into a liner string, said mandrel having an interior bore adapted to receive pressurized fluids from the well surface;

an upper and a lower set of circumferentially-spaced, gripping slips mounted about said mandrel, each of said gripping slips having a spring arm extending therefrom in axial alignment with said mandrel, the slips of one set being angularly oriented with respect to the other to align the spaces between one of the sets of slips with the slips of the other set;

an upper and a lower set of tapered, slip expander cones mounted on said mandrel, each said cone sets including a plurality of circumferentially-spaced cone segments mounted on said mandrel and arranged with one of said cone segments above each of said slips for expanding said slips radially outwardly in the direction of the surrounding well bore responsive to opposite relative movement of said slips and cones;

a plurality of channel guides, each of said channel guides being formed on the exterior of said mandrel in the spaces between circumferentially spaced cone segments in the lower of said tapered, slip expander cone sets, said channel guides including a slot portion for slidably receiving the spring arm of one of said slips in said upper set of gripping slips for supporting said slips on the exterior of said mandrel; and a hydraulic setting sleeve carried on said mandrel below said cone sets and connected to said slip spring arms for sliding said spring arms within said channel guides to thereby urge said slips in the direction of said cones to effect the outward, radial expansion of said slips to thereby hang said mandrel and, in turn, said liner within the well bore.

5. The liner of claim 4, wherein said gripping slips have a serrated upper surface and a stepped lower surface having a shoulder formed therein for receiving the end of said spring arms opposite the connection to said setting sleeve, each of said spring arms being connected to said slips by screws passing through said slip upper surface and into said spring arm, whereby force applied to said spring arms acts upon said shoulder formed in said slip lower surface.

* * * * *